United States Patent [19]

Aono

[11] 4,170,965

[45] Oct. 16, 1979

[54] COMPENSATION FOR INHERENT FLUCTUATION IN OUTPUT LEVEL OF EXHAUST SENSOR IN AIR-FUEL RATIO CONTROL SYSTEM FOR INTERNAL COMBUSTION ENGINE

[75] Inventor: Shigeo Aono, Seki, Japan

[73] Assignee: Nissan Motor Company, Limited, Japan

[21] Appl. No.: 729,826

[22] Filed: Oct. 5, 1976

[30] Foreign Application Priority Data

Oct. 27, 1975 [JP] Japan ..... 50-145316[U]

[51] Int. Cl.[2] ..... F02B 3/00

[52] U.S. Cl. ..... 123/32 EE

[58] Field of Search ..... 123/32 EE, 119 R, 140 MC, 123/119 EC; 60/276, 285

[56] References Cited

U.S. PATENT DOCUMENTS 3,973,529 8/1976 Wessel et al. ..... 60/276

*Primary Examiner*—Charles T. Jordan

*Attorney, Agent, or Firm*—Lane, Aitken & Ziems

[57] ABSTRACT

In a feedback control system for maintaining the air-fuel ratio of a combustible mixture fed to an internal combustion engine at a preset ratio, a fluctuation in the output characteristic of an exhaust sensor due to deterioration or low temperature is compensated for by varying a reference voltage, which serves as a standard of comparison, in response to a change in the mean value of the sensor output voltage.

3 Claims, 6 Drawing Figures

COMPENSATION FOR INHERENT FLUCTUATION IN OUTPUT LEVEL OF EXHAUST SENSOR IN AIR-FUEL RATIO CONTROL SYSTEM FOR INTERNAL COMBUSTION ENGINE

This invention relates to a feedback control system for maintaining the air-fuel ratio of a combustible mixture fed to an internal combustion engine at a preset ratio, which system is of the type having an exhaust sensor for estimating a realized air-fuel ratio; and, more particularly, to a method of compensating for an inherent fluctuation in the output characteristic of the exhaust sensor by establishing a reference signal in the feedback control system, the amplitude of which reference signal is variable according to a change in the output characteristic of the exhaust sensor, and an electrical circuit for accomplishing the method.

In internal combustion engines, it is important, from the standpoint of minimizing the concentration of pollutants in the exhaust gas, to maintain the air-fuel ratio of a combustible mixture fed to the engine exactly at an optimumly preset ratio. As is well known, the air-fuel ratio realized in the engine can be estimated from the concentration of a certain component of the exhaust gas (which may be $O_2$, CO, $CO_2$, HC or $NO_x$), and various types of exhaust sensors for this use are now available. In known feedback control systems for precisely controlling the air-fuel ratio, a control signal for regulating the fuel feed rate and/or the air feed rate in an air-fuel proportioning device such as a carburetor or a fuel injection system is typically produced in the following manner. Any deviation of the output of an exhaust sensor from a preset reference signal (which corresponds to the preset air-fuel ratio) is detected in a deviation detection circuit (for example, a differential amplifier or a comparator), and the control signal is produced by either multiplying or integrating the detected deviation or, alternatively, by the addition of the multiplied deviation (a proportional component of the control signal) to the integrated deviation (integral component).

The control signal is produced in the above described manner on the premise that the output of the exhaust sensor has a definite correlation with the air-fuel ratio of the combustible mixture consumed in the engine. However, practical exhaust sensors inevitably exhibit changes in their output characteristics when exposed to various temperatures and/or used for long periods of time, because the exhaust sensors have either a semiconductor or an electrolyte as the sensing element. When the relationship between the air-fuel ratio of the combustible mixture and the output of the exhaust sensor is different from a preliminarily calibrated one while the reference signal is maintained constant, the application of the control signal to the air-fuel proportioning device results in the regulation of the air-fuel ratio to a ratio which deviates undesirably from the preset ratio.

With respect to a feedback control system for maintaining the air-fuel ratio of a combustible mixture fed to an internal combustion engine at a preset ratio, which system includes an exhaust sensor capable of producing an electrical output representing the concentration of a component of the exhaust gas, which concentration is correlated to the air-fuel ratio realized in the engine, it is an object of the present invention to provide a method of compensating for an inherent fluctuation in the output characteristic of the exhaust sensor by establishing a reference voltage, which serves as a standard of comparison in detecting any deviation of the amplitude of the output of the sensor from an expected amplitude corresponding to the preset air-fuel ratio, and which automatically fluctuates in its amplitude in response to a change in the relationship between the aforementioned concentration and the amplitude of the output of the sensor.

It is another object of the invention to provide an electrical circuit as part of the above described feedback control system for establishing a reference voltage according to a method of the invention.

According to a method of the invention, an inherent fluctuation of the output characteristic of the exhaust sensor is compensated for by varying the reference voltage in response to and in a definite correlation with a change in the mean value of the output voltage of the exhaust sensor.

A circuit for producing a variable reference voltage according to the invention has a capacitor to which the output voltage of the exhaust sensor is continuously applied through a resistor and a voltage divider arranged to develop a reference voltage as a predetermined fraction of a voltage across the capacitor.

DETAILED DESCRIPTION

The invention will fully be understood from the following detailed description of preferred embodiments with reference to the accompanying drawings, wherein.

Figure 1:
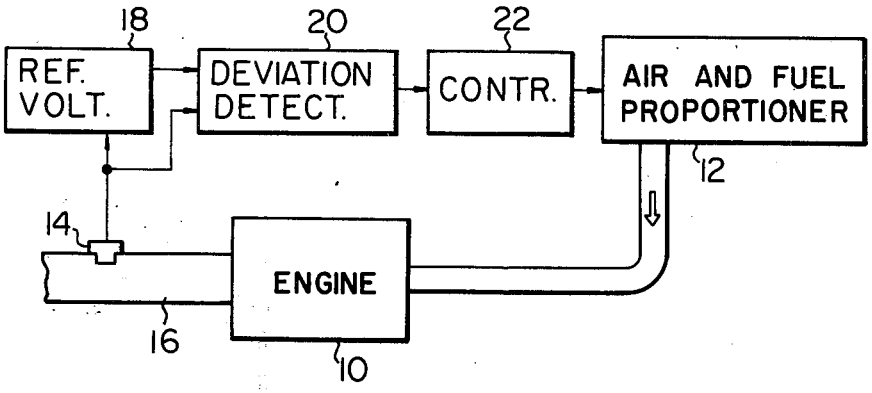
FIG. 1 is a block diagram of an air-fuel ratio control system in an internal combustion engine.

With respect to an internal combustion engine indicated at 10 in FIG. 1, an air-fuel ratio control system, which is the object of the invention, includes a controllable air-fuel proportioning device 12 such as a carburetor or a fuel injection system, an exhaust sensor 14 installed in the exhaust line 16 of the engine 10, an electrical circuit 18 for producing a reference voltage, another electrical circuit 20 exemplified by a differential amplifier or a comparator arranged to receive the output of the exhaust sensor 14 and the reference voltage and produce an output signal representing the magnitude of the deviation of the output of the exhaust sensor 14 from the reference voltage, and a control circuit 22 which produces a control signal for the control of the air-fuel proportioning device 12 by modulating the output signal of the comparison circuit 20 in a manner as hereinbefore described. In conventional air-fuel ratio control systems of the illustrated type, the circuit 18 has merely the function of providing a constant reference voltage to the comparison circuit 20—the output of the exhaust sensor 14 is not applied to this circuit. According to the invention, the output of the exhaust sensor 14 is applied to both the comparison circuit 20 and the reference signal producing circuit 18 as will hereinafter be described in detail.

Figure 2:
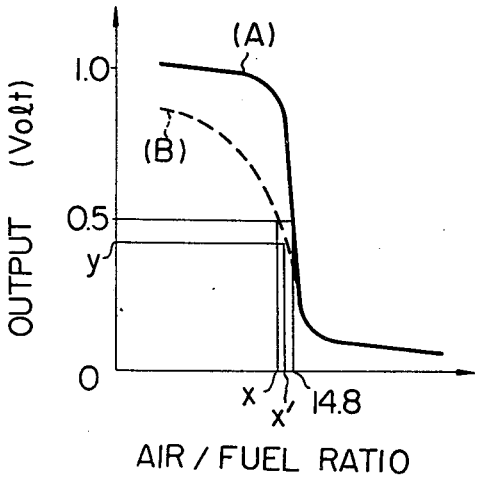
FIG. 2 is a graph showing the output characteristic of a conventional oxygen sensor employed as the exhaust sensor in the control system of FIG. 1 and explains the influence of a fluctuation in the output characteristic of the sensor and a variation in the amplitude of a reference signal on the accuracy of the control of the air-fuel ratio.

At present, a familiar example of the exhaust sensor 14 is an oxygen sensor which is essentially an oxygen concentration cell having a solid electrolyte, for example, of a stabilized zirconia system. When such an oxygen sensor is used as the exhaust sensor 14 in the control system of FIG. 1 and the engine 10 is a gasoline engine, the output voltage of the oxygen sensor varies as represented by the curve (A) in FIG. 2 as the air-fuel ratio (by weight) of the combustible mixture consumed in the engine 10 varies. In many cases, the control system will be adjusted to maintain the air-fuel (gasoline) ratio exactly at or close to the stoichiometric ratio which is about 14.8. If the output voltage of the oxygen sensor is 0.5 volts when the air-fuel ratio is 14.8, a 0.5 volt signal may constantly be applied to the comparison circuit 20 in order to correct any deviation of the air-fuel ratio from 14.8.

However, the output characteristic of the oxygen sensor shifts from the curve (A) to a different curve (B) when the sensor is exposed to the exhaust gas for a prolonged period of time. On the curve (B), the output voltage for air-fuel ratios below a point near the stoichiometric ratio is lower than that on the curve (A). A similar lowering of the output voltage occurs also when the oxygen sensor is used at relatively low temperatures because of a noticeable increase in the internal resistance of the sensor. If the reference voltage is kept at 0.5 volts even though the output characteristic of the oxygen sensor has varied as represented by the curve (B), the air-fuel ratio control system fails to maintain the air-fuel ratio at 14.8 as intended, since the air-fuel ratio is regulated to a lower ratio indicated at x in FIG. 2.

Figure 3:
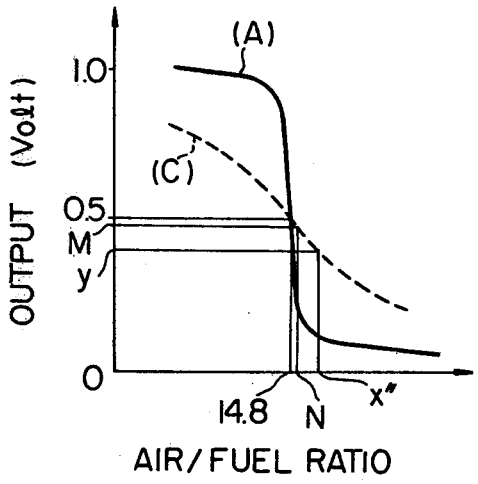
FIG. 3 is another graph for the same purpose as FIG. 2 but shows a case in which the output characteristic of the sensor fluctuates in a different manner.

When the output characteristic of the sensor, either in a deteriorated state or in a low temperature state, is as represented by the curve (B) in comparison with the normal characteristic of the curve (A), the above described error in the control of the air-fuel ratio may be lessened by varying the reference voltage in a certain relation with a maximal value of the output voltage of the sensor. If the reference voltage is so varied as to always equal to ½ of a maximal value of the output voltage of the sensor, the reference voltage will lower from 0.5 volts to y volts in the case when the sensor exhibits the output characteristic of the curve (B). As the result, the air-fuel ratio is regulated to a ratio x′ which is closer to 14.8 than the ratio x is. However, the output characteristic of a deteriorated oxygen sensor is not always as represented by the curve (B), but sometimes becomes as represented by the curve (C) in FIG. 3 (for example, as the result of a degradation in the responsiveness of the sensor). If the reference voltage is varied to be ½ of a maximal value of the output voltage of the sensor and, thus lowers to y volts according to the output characteristic of the curve (C), the air-fuel ratio is regulated to a ratio x″ in FIG. 3 which is considerably greater than 14.8.

According to the invention, the circuit 18 in FIG. 1 produces a variable voltage signal whose amplitude has a predetermined relation with the mean value of maximal and minimal values of the output of the exhaust sensor 14. Assume that the reference voltage is made to be about 9/10, for example, fo the mean value for the above described oxygen sensor, that the output of the oxygen sensor exhibits a lowering of its maximal value, and, at the same time, a rise in its minimal value as represented by the curve (C) in FIG. 3. The reference voltage will then take a value M which is very close to 0.5 volts (the reference voltage for the oxygen sensor in the normal state), so that the air-fuel ratio can be regulated to a ratio N which is much closer to 14.8 than the ratio x″ is. Also, when the output characteristic of the sensor is as represented by the curve (B) in FIG. 2, the air-fuel ratio can be maintained at a ratio closer to 14.8 than the ratio x′ (though the difference may only be slight) by varying the reference voltage as a function of the mean value of maximal and minimal values of the sensor output.

Figure 4:
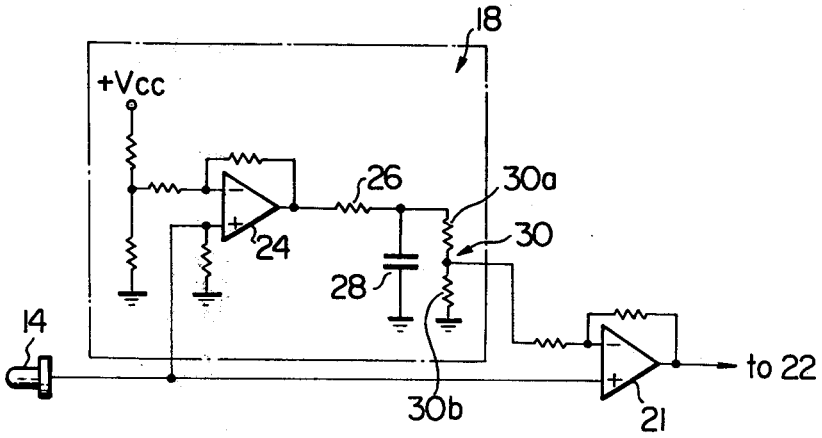
FIG. 4 is a diagram of a circuit for producing a variable reference voltage as an embodiment of the invention.

FIG. 4 shows an example of the construction of the circuit 18 for producing a variable reference signal according to the invention. The output of the exhaust sensor 14, for example, an oxygen sensor of the above described type, is applied to both the positive input terminal of a differential amplifier 21 (which serves as the comparison circuit 20 in FIG. 1) and the reference voltage producing circuit 18. An operational amplifier 24 is arranged to provide a high input impedance to the circuit 18 as the input thereto, so that the output of the exhaust sensor 14 may be applied to the differential amplifier 21 without being influenced by the circuit 18. The output of the exhaust sensor 14 is applied to the positive terminal of this operational amplifier 24. A constant voltage represented by Vcc is applied to the negative input terminal of the operational amplifier 24 through resistors (no numeral) in the usual manner. The output of the operational amplifier 24 is applied to a mean value circuit consisting of a capacitor 28, a resistor 26 interposed between the operational amplifier 24 and the capacitor 28, and a voltage divider 30, which is connected in parallel with the capacitor 28 and has two resistors **30*a* and 30*b*. The junction point between these two resistors 30*a* and 30*b* is connected to the negative input terminal of the differential amplifier 21 through a resistor (unnumbered), so that the differential amplifier 21 supplies an output signal representing the deviation of the output voltage of the exhaust sensor 14 from the output voltage of the mean value circuit to the control circuit 22 in FIG. 1. In the mean value circuit, the voltage at the junction between the resistor 26 and the capacitor 28 represents the mean value of the maximal and minimal values of the output of the exhaust sensor 14. The ratio of the resistance of the resistor 30*a* to the resistance of the resistor 30*b* is chosen such that the voltage divider 30** provides a voltage (the output of the mean value circuit) which is in a predetermined proportion (for example, 1/1, 4/5 or ¾) to the mean value.

Figure 5:
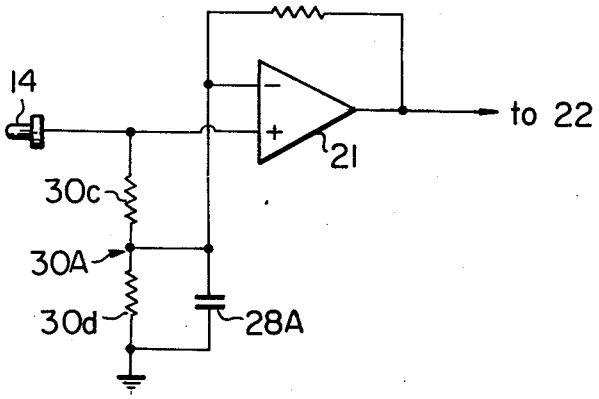
FIG. 5 is a diagram of a differently constructed circuit for the same purpose as another embodiment of the invention.

FIG. 5 shows another embodiment of the reference voltage producing circuit 18 according to the invention. In this case the circuit 18 substantially consists of a mean value circuit which is made up of a capacitor 28A and a voltage divider 30A having two resistors **30*c* and 30*d*. Divided by the voltage divider 30A connected as illustrated, a fraction of the output voltage of the exhaust sensor 14 is applied to the capacitor 28A, so that the resistor 26 in the circuit of FIG. 4 can be omitted. The other resistor 30*d* is connected in parallel with the capacitor 28A. The junction point between the two resistors 30*c* and 30*d* of the voltage divider 30A is connected to the negative input terminal of the differential amplifier 21. The output of the exhaust sensor 14 is applied also to the positive input terminal of the differential amplifier 21. The mean value circuit of FIG. 5 has the same function as the mean value circuit of FIG. 4** but features a simplified construction.

Figure 6:
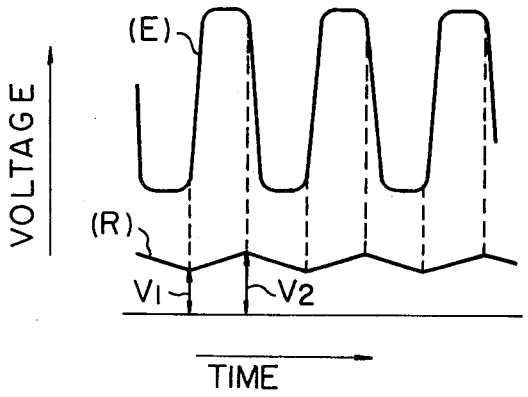
FIG. 6 is a chart showing the relationship between the output of the exhaust sensor and the output of a reference signal producing circuit according to the invention.

A reference voltage producing circuit according to the invention exhibits an improved responsiveness to a fluctuation in the output voltage of the exhaust sensor 14 resulting from a fluctuation in the air-fuel ratio realized in the engine 10. The improved responsiveness is derived from a reverse dynamic hysteresis of the output of the mean value circuit, which output is obtained as a definite fraction of the terminal voltage of the capacitor 28 or 28A, in association with the differential amplifier 21. If the output voltage of the exhaust sensor 14 exhibits a periodic fluctuation as represented by the curve (E) in FIG. 6, the output of the mean value circuit (the reference voltage) of either FIG. 4 or FIG. 5 varies as represented by the curve (R). As seen, the reference voltage takes a minimal value $V_1$ when the output of the sensor 14 begins to rise from a minimal value and takes a maximal value $V_2$ when the sensor output begins to lower from a maximal value. Accordingly, the air-fuel control system of FIG. 1 can accomplish the control in an anticipatory manner. The level of the control signal begins to vary rather in advance of the detection of a significant fluctuation in the realized air-fuel ratio, so that the control system exhibits an improved responsiveness.

Thus, a method according to the invention allows an air-fuel ratio control system of the described type to maintain the air-fuel ratio precisely at a preset ratio even though the exhaust sensor 14 in the control system deteriorates and exhibits a change in its output characteristic. Consequently, a separate system for minimizing the concentration of noxious components of the exhaust gas of the engine 10 can work efficiently for a prolonged period of time. In addition, it becomes possible by the method and apparatus of the invention to operate the air-fuel control system with high accuracy even when the engine 10 is at such low temperatures that the exhaust temperature is not high enough to allow a normal function of the exhaust sensor 14. Under such a low temperature condition, conventional air-fuel control systems which employ a constant reference voltage cannot accomplish an accurate control of the air-fuel ratio and, hence, must be kept at rest. The invention also solves such a problem in conventional air-fuel ratio control systems.

What is claimed is:

1. A method for compensating for an inherent fluctuation in the output characteristic of an exhaust sensor which is installed in an exhaust line of an internal combustion engine as an element of a feedback control system for maintaining the air-fuel ratio of a combustible mixture fed to the engine at a predetermined ratio and produces an output voltage representing the concentration of a definite component of the exhaust gas of the engine, the concentration being in dependence on the air-fuel ratio of the combustible mixture consumed in the engine, the control system controlling the function of an air-fuel proportioning device based on the magnitude of a deviation of the output voltage of the exhaust sensor from a reference voltage, the method comprising the steps of varying the reference voltage in response to a change in a mean value of the output voltage of the exhaust sensor such that the reference voltage is always in a predetermined proportion tc the mean value and comparing the output voltage of the exhaust sensor with the varied reference voltage.

2. In a feedback control system for maintaining the air-fuel ratio of a combustible mixture fed to an internal combustion engine at a predetermined ratio, the system including an exhaust sensor which is installed in the exhaust line of the engine and produces an output voltage representing the concentration of a definite component of the exhaust gas, the concentration being in dependence on the air-fuel ratio of the combustible mixture consumed in the engine, a comparison circuit to detect the magnitude of a deviation of the output voltage of the exhaust sensor from a reference voltage and a control circuit to control the function of an air-fuel proportioning device based on the detected magnitude of the deviation, wherein the improvement comprises:

said comparison circuit comprising a comparator which receives directly and continually the output voltage of said exhaust sensor and a reference voltage producing circuit having a capacitor, a voltage divider connected in parallel with said capacitor, and an operational amplifier with a positive input terminal thereof connected to said exhaust sensor, a negative input terminal thereof connected to a source of constant voltage and an output terminal thereof connected to said capacitor through a first resistor and also to said negative input terminal through a second resistor such that said operational amplifier provides a high input impedance to said reference voltage producing circuit and that said capacitor receives continually the output voltage of said exhaust sensor through said operational amplifier and said first resistor and is discharged not only through said voltage divider but also through said first resistor upon a lowering of the output voltage of said exhaust sensor, so that said voltage divider is impressed continually with the terminal voltage of said capacitor and provides an output voltage which is in a predetermined proportion to the terminal voltage of said capacitor and corresponds to a mean value of the output voltage of said exhaust sensor, said output voltage provided by said voltage divider being applied continually to said comparator as said reference voltage, said comparator being a differential amplifier with a positive input terminal thereof connected directly to said exhaust sensor and a negative input terminal thereof connected to the output terminal of said voltage divider.

3. In a feedback control system for maintaining the air-fuel ratio of a combustible mixture fed to an internal combustion engine at a predetermined ratio, the system including an exhaust sensor which is installed in the exhaust line of the engine and produces an output voltage representing the concentration of a definite component of the exhaust gas, the concentration being in dependence on the air-fuel ratio of the combustible mixture consumed in the engine, a comparison circuit to detect the magnitude of a deviation of the output voltage of the exhaust sensor from a reference voltage and a control circuit to control the function of an air-fuel proportioning device based on the detected magnitude of the deviation, wherein the improvement comprises: said comparison circuit comprising a comparator connected to said exhaust sensor so as to receive continually the output voltage of said exhaust sensor and a reference voltage producing circuit having a capacitor, a voltage divider connected to said capacitor such that said capacitor receives continually a fraction of the output voltage of said exhaust sensor divided by said voltage divider and is discharged, upon a lowering of the output voltage of said exhaust sensor, through one of two series connected resistors of said voltage divider, whereby said voltage divider provides an output voltage which is in a predetermined proportion to the terminal voltage of said capacitor and corresponds to a mean value of the output voltage of said exhaust sensor, said output voltage provided by said voltage divider being applied continually to said comparator as said reference voltage, said comparator being a differential amplifier with a positive input terminal thereof connected directly to said exhaust sensor and a negative input terminal thereof connected to the output terminal of said voltage divider.

* * * * *